US010462589B2

(12) United States Patent
Higgins et al.

(10) Patent No.: US 10,462,589 B2
(45) Date of Patent: Oct. 29, 2019

(54) ELASTOMERIC WAX BARRIER FOR HEARING AID ACOUSTIC PORT

(71) Applicant: Starkey Laboratories, Inc., Eden Prairie, MN (US)

(72) Inventors: Sidney A. Higgins, Maple Grove, MN (US); John Becker, Delano, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 15/274,696

(22) Filed: Sep. 23, 2016

(65) Prior Publication Data

US 2017/0094432 A1 Mar. 30, 2017

Related U.S. Application Data

(60) Provisional application No. 62/232,403, filed on Sep. 24, 2015.

(51) Int. Cl.
*H04R 1/10* (2006.01)
*H04R 25/00* (2006.01)

(52) U.S. Cl.
CPC ..... *H04R 25/654* (2013.01); *H04R 2225/023* (2013.01); *H04R 2460/09* (2013.01); *H04R 2460/17* (2013.01)

(58) Field of Classification Search
CPC ... H04R 25/652; H04R 25/654; H04R 25/505
USPC ..... 381/325
See application file for complete search history.

(56) References Cited

U.S. PATENT DOCUMENTS 4,471,171 A * 9/1984 Kopke et al. ..... A61B 5/12 381/312
4,553,627 A * 11/1985 Gastmeier ..... H04R 25/654 128/864
5,131,128 A * 7/1992 Bisgaard ..... H04R 25/654 29/239
5,278,360 A * 1/1994 Carbe ..... H04R 25/654 181/135
5,293,008 A * 3/1994 Danielsen ..... H04R 25/654 181/135
5,327,500 A * 7/1994 Campbell ..... H04R 25/654 381/322
6,000,492 A * 12/1999 Puthuff ..... H04R 25/654 181/135

(Continued)

OTHER PUBLICATIONS

"European Application Serial No. 16190560.9, Extended European Search Report dated Jan. 24, 2017", 7 pgs.

*Primary Examiner* — Curtis A Kuntz
*Assistant Examiner* — Ryan Robinson
(74) *Attorney, Agent, or Firm* — Schwegman Lundberg & Woessner, P.A.

(57) ABSTRACT

Described is a solid wax mitigation barrier for a hearing aid that is cleanable via a simple wiping motion, is not a cause of irritation within the ear canal, and is acoustically transparent. In one embodiment, a wax barrier function is provided by a tube cap for fitting over the acoustic port tube of a hearing aid receiver. The tube cap may be constructed of an elastomeric high tear strength material so as create a small flexible acoustic tube cap that prevents direct ingress of wax into the hearing aid receiver. The design of the cap may also include a bridge that spans an acoustic port inlet so as to block direct material ingress.

17 Claims, 2 Drawing Sheets

(56) References Cited

U.S. PATENT DOCUMENTS

| | | | | |
|---|---|---|---|---|
| 6,105,713 | A * | 8/2000 | Brimhall | H04R 25/654 181/135 |
| 8,457,336 | B2 * | 6/2013 | Ladabaum | H04R 25/656 381/324 |
| 9,277,336 | B2 * | 3/2016 | Moller | H04R 25/652 |
| 2005/0271229 | A1 | 12/2005 | Hanses et al. | |
| 2006/0280325 | A1 | 12/2006 | Lin et al. | |
| 2011/0299712 | A1 * | 12/2011 | Bondo | H04R 25/654 381/325 |
| 2016/0057528 | A1 * | 2/2016 | Trine | H04R 25/654 381/380 |

* cited by examiner

ELASTOMERIC WAX BARRIER FOR HEARING AID ACOUSTIC PORT

CROSS-REFERENCE TO RELATED APPLICATION

This patent application claims the benefit of U.S. Provisional Patent Application No. 62/232,403, filed Sep. 24, 2015, entitled "Elastomeric Wax Barrier for Hearing Aid Acoustic Port", which is incorporated by reference herein in its entirety.

FIELD OF THE INVENTION

This invention pertains to electronic hearing aids and methods for their construction.

BACKGROUND

Hearing aids are electroacoustic device which amplify sound for the wearer in order to correct hearing deficits as measured by audiometry, usually with the primary purpose of making speech more intelligible. In certain types of hearing aids, sound produced by the hearing aid's receiver (or loudspeaker) is conducted via an acoustic port that is placed in the wearer's external ear canal. A receiver-in-canal (RIC) hearing aid, for example, has a small body that sits behind the ear and houses the hearing aid's microphone and audio processing circuitry. The receiver of the RIC hearing aid is attached to an earbud inside the ear and is connected to the body of the hearing aid by a cable or slim tube that houses the receiver wiring. In another type of hearing aid, referred to as completely-in-canal (CIC) hearing aids, the entire device including the receiver is placed in the wearer's external ear canal. A problem with such hearing aids is wax build-up inside the ears that can get into and permanently damage the receiver.

DETAILED DESCRIPTION

Described herein is a solid wax mitigation barrier for a hearing aid that is cleanable via a simple wiping motion, is not a cause of irritation within the ear canal, and is acoustically transparent. The described was barrier is also field serviceable, low cost while being mechanically robust, and will fit a wide variety of custom products. The wax barrier also allows a clinician access to the acoustic port of the hearing aid receiver without removal of the barrier.

Figure 1:
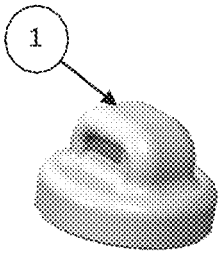
FIG. 1 shows an example tube cap for preventing wax ingress into a hearing aid receiver.
Figure 2:
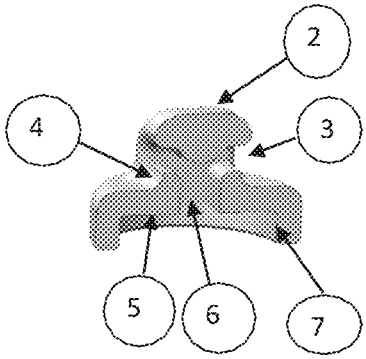
FIG. 2 shows the tube cap in cross-section.

In one embodiment, a wax barrier function is provided by a tube cap for fitting over the acoustic port tube of a hearing aid receiver. FIG. 1 shows a tube cap 1 designed to be fit over the acoustic port of a hearing aid receiver. FIG. 2 shows the tube cap 1 in cross-section. The tube cap 1 may be constructed of an elastomeric high tear strength material so as create a small flexible acoustic tube cap that prevents direct ingress of wax into the hearing aid receiver. The design of the cap 1 includes a bridge 2 that spans the acoustic port inlet 6 so as to block direct material ingress. When external forces are applied to the bridge 2, it will deflect into the cradle formed by the two side barriers 4 and block the ingress path. In free space, the bridge maintains an open condition that creates two acoustically transparent sound ports 3 between the bridge and the side barriers. This creates a dam that will use surface tension to limit liquid wax ingress. When a wiping action is exerted onto the tip of the cap 1, the bridge 2 will stretch away from the acoustic port inlet 6 and slightly invert. This allows for a thorough cleaning of the bridge 2, side barriers 4, and the acoustic port inlet 6. Any solid wax left blocking or collecting beyond the acoustic port 6 can be cleaned away with a spiral bristled brush commonly used to clean vents in custom devices. The loop portion of a common wax brush can also be used in the same manner. Due to the elastomeric nature of the wax barrier the bridge 2, it can easily be pulled to the side and the acoustic path maintained all the way down to the receiver by a clinician during regularly scheduled visits. The described design thus puts the functional features into the wall section of the wax barrier device itself and uses the elastomeric nature of the material to create the controlled actions needed to block and remove wax.

Figure 3:
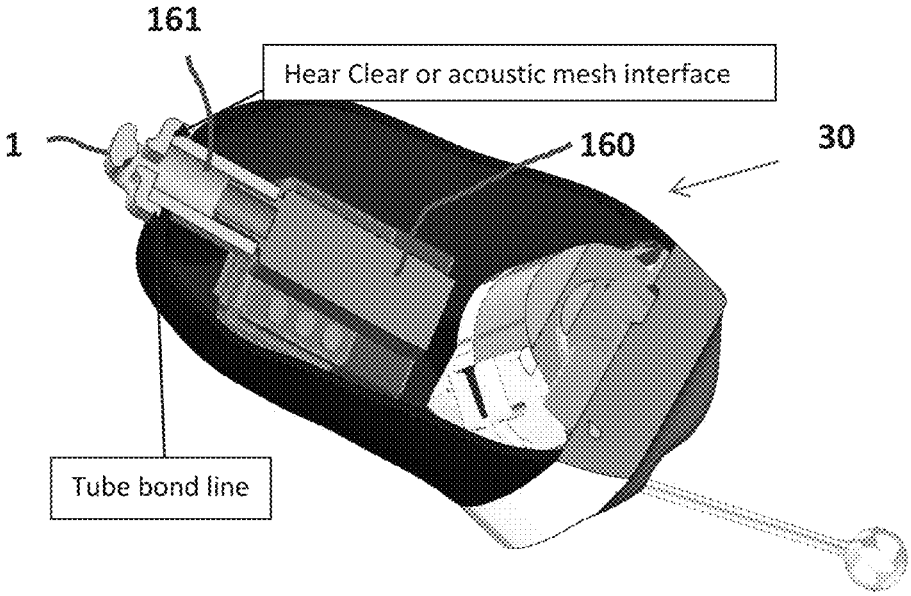
FIG. 3 shows an example hearing aid with a tube cap bonded to the receiver's acoustic port tube.

FIG. 3 shows an example hearing aid 30 that is designed to be worn in a patient's external ear canal. A receiver 160 conducts sound through an acoustic port tube 161 and then out into the wearer's ear canal. A tube cap 1 as described above is fit over and bonded to the acoustic port tube 161. The bonding interface 7 of the tube cap 1 may be sized to match all the receiver tubing commonly used in manufacturing. The top surface of the tube interface 5 may be left free of adhesive to allow for the inclusion of a secondary wax block to be used (e.g., an acoustic mesh) if needed.

Figure 4:
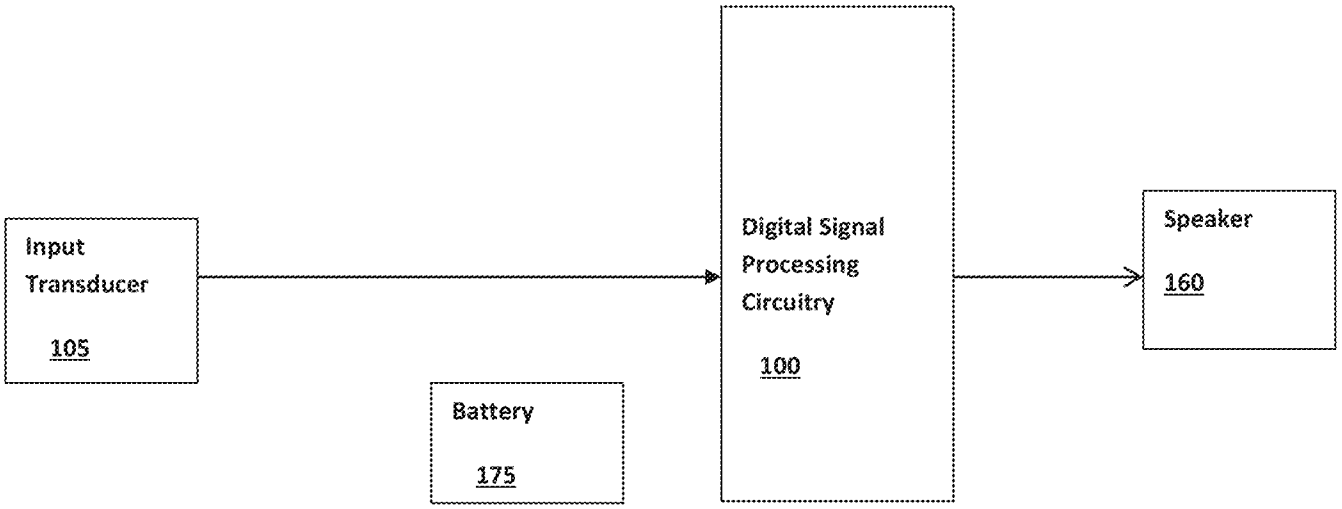
FIG. 4 shows the basic electronic components of an example hearing aid.

FIG. 4 illustrates the basic functional components of an example hearing aid. Hearing aids are devices that compensate for hearing losses by amplifying sound whose electronic components include a microphone for receiving ambient sound, an amplifier for amplifying the microphone signal in a manner that depends upon the frequency and amplitude of the microphone signal, a speaker for converting the amplified microphone signal to sound for the wearer, and a battery for powering the components. The electronic circuitry of the hearing aid is contained within a housing that may be placed, for example, in the external ear canal or behind the ear. An input transducer (i.e., microphone) 105 receives sound waves from the environment and converts the sound into an input signal. After amplification by a pre-amplifier, the input signal is sampled and digitized to result in a digitized input signal that is passed to digital signal processing (DSP) circuitry 100. The DSP circuitry processes the digitized input signal into an output signal in a manner that compensates for the patient's hearing deficit (e.g., frequency-specific amplification and compression). The output signal is then converted to analog form and passed to an audio amplifier that drives a receiver 160 (a.k.a. a loudspeaker) to convert the output signal into an audio output. A battery 175 supplies power for the electronic components. In an RIC hearing aid, the receiver 160 may be attached to an earbud such as described above that is placed in the external ear canal, while the rest of the hearing aid components are housed in a main body that is usually placed behind ear. In other types of hearing aids, the receiver 160 may be housed in the main body with sound conducted to the earbud via an audio tube.

Example Embodiments

In an example embodiment, a hearing aid comprises: an input transducer for converting an audio input into an input signal; a digital signal processor (DSP) for processing the input signal into an output signal in a manner that compensates for a patient's hearing deficit; an audio amplifier and receiver for converting the output signal into an audio output; and an elastomeric wax barrier as described above attached to the receiver.

In another example embodiment, a hearing aid comprises: a receiver with an acoustic port tube for conducting sound into a wearer's external ear canal; a tube cap bonded to the acoustic port tube; wherein the tube cap comprises an acoustic port inlet and a bridge spanning the acoustic port inlet to prevent direct ingress of wax material.

In another example embodiment, a tube cap for fitting over an acoustic port tube of a hearing aid receiver comprises: a bridge for preventing direct ingress of wax into the acoustic port tube; a side barrier on each of the two sides of the bridge; an acoustic port inlet bordered by two ends of the bridge and two side barriers; and, wherein the bridge spans the acoustic port inlet and provides two acoustically transparent sound ports between the bridge and the side barriers. The tube cap may be made of elastomeric material.

Hearing assistance devices typically include an enclosure or housing, a microphone, hearing assistance device electronics including processing electronics, and a speaker or receiver. It is understood that in various embodiments the microphone is optional. It is understood that in various embodiments the receiver is optional. Such devices may include antenna configurations, which may vary and may be included within an enclosure for the electronics or be external to an enclosure for the electronics. Thus, the examples set forth herein are intended to be demonstrative and not a limiting or exhaustive depiction of variations.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the wearer.

It is understood that digital hearing aids include a processor. In digital hearing aids with a processor programmed to provide corrections to hearing impairments, programmable gains are employed to tailor the hearing aid output to a wearer's particular hearing impairment. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing aid, comprising:

a receiver with an acoustic port tube for conducting sound into a wearer's external ear canal;

a tube cap bonded to the acoustic port tube;

wherein the tube cap comprises an acoustic port inlet, a bridge spanning the acoustic port inlet to prevent direct ingress of wax material, and a side barrier extending from the tube cap toward the bridge and running parallel to the bridge on each of the bridge's two sides;

wherein the side barriers on each of the two sides of the bridge form two acoustic ports between the bridge and the two side barriers that are transverse to the axis of the acoustic port inlet;

wherein the tube cap is constructed such that, when an external force is applied to the bridge toward the acoustic port inlet, the bridge is deflected into a cradle formed by the side barriers to block ingress of wax material; and, wherein the tube cap is constructed such that, when a wiping action is exerted onto the tip of the tube cap along the axes of the acoustic ports, the bridge partially inverts to allow cleaning.

2. The hearing aid of claim 1 wherein the tube cap is made of elastomeric material.

3. The hearing aid of claim 1 wherein, when no external force is applied to the bridge, the bridge maintains an open condition that creates two acoustically transparent sound ports between the bridge and two side barriers.

4. The hearing aid of claim 1 further comprising an acoustic mesh disposed in the acoustic port inlet.

5. The hearing aid of claim 1 wherein the hearing aid is a receiver-in-canal (RIC) hearing aid.

6. The hearing aid of claim 1 wherein the hearing aid is a completely-in-canal (CIC) hearing aid.

7. A tube cap for fitting over an acoustic port tube of a hearing aid receiver; comprising:

a bridge for preventing direct ingress of wax into the acoustic port tube;

a side barrier on each of the two sides of the bridge extending from the tube cap toward the bridge and running parallel to the bridge;

wherein the side barriers on each of the two sides of the bridge form two acoustic ports between the bridge and the two side barriers that are transverse to the axis of the acoustic port inlet;

wherein the tube cap is constructed such that, when an external force is applied to the bridge toward the acoustic port inlet, the bridge is deflected into a cradle formed by the side barriers to block ingress of wax material; and, wherein the tube cap is constructed such that, when a wiping action is exerted onto the tip of the tube cap along the axes of the acoustic ports, the bridge partially inverts to allow cleaning.

8. The tube cap of claim 7 wherein the tube cap is made of elastomeric material.

9. The tube cap of claim 7 wherein, when no external force is applied to the bridge, the bridge maintains an open condition that creates two acoustically transparent sound ports between the bridge and two side barriers.

10. The tube cap of claim 7 further comprising an acoustic mesh disposed in the acoustic port inlet.

11. A method for constructing a hearing aid, comprising:

constructing a tube cap that comprises an acoustic port inlet, a bridge spanning the acoustic port inlet to prevent direct ingress of wax material, and a side barrier on each of the two sides of the bridge extending from the tube cap toward the bridge and running parallel to the bridge;

wherein the side barriers on each of the two sides of the bridge form two acoustic ports between the bridge and the two side barriers that are transverse to the axis of the acoustic port inlet;

constructing the tube cap so that, when an external force is applied to the bridge toward the acoustic port inlet, the bridge is deflected into a cradle formed by the side barriers to block ingress of wax material;

constructing the tube cap such that, when a wiping action is exerted onto the tip of the tube cap along the axes of the acoustic ports, the bridge partially inverts to allow cleaning.

12. The method of claim 11 wherein the tube cap is made of elastomeric material.

13. The method of claim 11 further comprising constructing the tube cap such that, when no external force is applied to the bridge, the bridge maintains an open condition that creates two acoustically transparent sound ports between the bridge and two side barriers.

14. The method of claim 11 further comprising disposing an acoustic mesh in the acoustic port inlet.

15. The method of claim 11 further comprising connecting a hearing aid receiver to an audio amplifier driven by a microphone and digital processing circuitry.

16. The method of claim 15 further comprising disposing the hearing aid receiver in a receiver-in-canal (RIC) hearing aid housing.

17. The method of claim 15 further comprising disposing the hearing aid receiver in a completely-in-canal (CIC) hearing aid housing.

* * * * *